United States Patent [19]

Ishii et al.

[11] Patent Number: 4,664,723

[45] Date of Patent: May 12, 1987

[54] SAMARIUM-COBALT TYPE MAGNET POWDER FOR RESIN MAGNET

[75] Inventors: Junichi Ishii, Chiba; Koichi Oka, Ichikawa, both of Japan

[73] Assignee: Sumitomo Metal Mining Company Limited, Tokyo, Japan

[21] Appl. No.: 796,224

[22] Filed: Nov. 8, 1985

[30] Foreign Application Priority Data

Nov. 9, 1984 [JP] Japan ..... 59-235077
Nov. 9, 1984 [JP] Japan ..... 59-235078

[51] Int. Cl.[4] ..... H01F 1/04

[52] U.S. Cl. ..... 148/301; 75/252; 148/425; 420/435; 524/403

[58] Field of Search ..... 148/31.57, 425; 420/435; 524/403; 75/252

[56] References Cited

U.S. PATENT DOCUMENTS

| | | | |
|---|---|---|---|
| 3,615,911 | 10/1971 | Nesbitt et al. | 420/435 |
| 3,919,003 | 11/1975 | Benz | 148/31.57 |
| 4,156,623 | 5/1979 | Becker | 148/103 |
| 4,208,225 | 6/1980 | Kurz et al. | 148/31.57 |
| 4,264,361 | 4/1981 | Yajima et al. | 148/31.57 |

*Primary Examiner*—John P. Sheehan

*Attorney, Agent, or Firm*—Watson, Cole, Grindle & Watson

[57] ABSTRACT

This invention is directed to a samarium-cobalt type magnetic powder for use in making a resin magnet, characterized by substantially comprising a $SmCo_5$ single phase and consisting of, by weight, 32.7 to 33.4% samarium, 65 to 67% cobalt, not more than 1.5% as a total of lanthanum, cerium, praseodymium and neodymium and the balance inevitably entrained impurities.

9 Claims, No Drawings

SAMARIUM-COBALT TYPE MAGNET POWDER FOR RESIN MAGNET

BACKGROUND OF THE INVENTION

1. Field of the Invention

This invention relates to a samarium-cobalt type magnet powder which possesses excellent magnetic properties and is suitable for use in making resin magnet.

2. Description of the Prior Art

It is known to make resin magnets from a samarium-cobalt type magnet powder (hereinafter referred to as "magnet powder") which has been mixed with a resin, such as a polyamide resin. Such resin magnets are used in motors, household electrical applicances, etc.

Generally, the magnetic powder is produced by the so-called melt method, which comprises melting and casting metallic samarium (Sm) and metallic cobalt (Co) so as to produce a samarium-cobalt alloy ingot, then heat treating the ingot, and then pulverizing the ingot; alternatively, it is produced by the so-called reduction-diffusion method, which comprises heating a mixture of samarium oxide with cobalt powder, reducing the samarium oxide with a reducing agent such as vaporous or mixed solid calcium, diffusing the formed samarium in the cobalt powder, throwing the formed reaction product into water to form a slurry, and then treating the slurry with water and an aqueous acid solution. Elements such as germanium can be added to the raw material to improve the magnetic properties of the magnet powder.

The magnet powder produced by the conventional method, however, is liable to inconsistency and instability of its magnetic properties. The method itself is complicated operationally. Thus, the magnet powder has not necessarily proved satisfactory.

SUMMARY OF THE INVENTION

In order to provide a magnet powder having consistent, stable and excellent magnetic properties suitable for a resin magnet, the inventors examined the aforementioned conventional magnet powder by the X-ray diffraction method and found that it contained intermetallic compounds of various phases including not only the $SmCo_5$ phase but also the $SmCo_3$ phase, the $Sm_2Co_7$ phase and the $Sm_2Co_{17}$ phase, and these intermetallic compounds, except for the $SmCo_5$ phase, had adverse effects upon the magnetic properties of the magnet powder.

The inventors, therefore, searched of a method for obtaining a magnet powder possessing a sole phase of $SmCo_5$ intermetallic compound.

The inventors found that a magnet powder compounded so as to contain samarium and cobalt in amounts respectively falling within specific ranges and further containing lanthanum, cerium, praseodymium, and neodymium in a total amount falling within a specific range, fulfills the object of this invention. To be specific, this invention is directed to a samarium-cobalt type magnet powder for resin magnet, characterized by substantially comprising a $SmCo_5$ single phase and consisting of 32.7 to 33.4% by weight of samarium, 65.0 to 67.0% by weight of cobalt, not more than 1.5% by weight as the total of lanthanum, cerium, praseodymium, and neodymium, and the balance of inevitably entrained impurities.

The other objects and characteristics of the present invention will become apparent from the disclosure to be made in the following description of a preferred embodiment of the invention.

DETAILED DESCRIPTION OF THE INVENTION

The magnet powder of this invention can be produced by subjecting raw materials containing lanthanum (La), cerium (Ce), praseodymium (Pr), and neodymium (Nd), as well as samarium and cobalt, to any of the conventional methods such as the melt method or the reduction-diffusion method. The samarium-cobalt alloy ingot obtained by the melt method or the product of the reaction of reduction-diffusion is desired to avoid undergoing such heat treatment as solution treatment, aging, or uniformization. The heat treatment degrades the magnetic properties of the alloy ingot. This degradation of the magnetic properties may be logically explained by a supposition that owing to the heat treatment, the samarium content of the magnet powder is caused to deviate from the fixed range of 32.7 to 33.4% by weight or, if the deviation is avoided, the samarium is caused to form such phases as $SmCo_3$, $Sm_2Co_7$, and $Sm_2Co_{17}$ in addition to the $SmCo_5$ phase.

Examples of the resin which is mixed with the magnet powder for the production of the resin magnet include thermoplastic resins such as polyamide resins (nylon 6, nylon 12, nylon 66, nylon 610, etc.), polycarbonate resin, acrylonitrile-butadiene-styrene copolymer, polyphenylene sulfide resin, and polyether-ether-ketone resins and thermosetting resins such as epoxy resin, phenol resin, amino resin, and unsaturated polyester resin.

Magnet powder samples of varying percentage compositions indicated in Table 1 were prepared by the melt method (not including a heat treatment) and each mixed with 8.5% by weight of polyamide resin (nylon 6) in an extrapolative ratio. The resultant mixtures were pelletized and then injection molded within a magnetic field of 15 kOe. The resin magnets consequently obtained were tested for magnetic properties. The residual magnetic flux density, Br (kG), the coercive force, bHc (kOe), and the maximum energy product, $(BH)_{max}$ (MGOe), were measured with a DC magnetic fluxmeter. The results are shown in Table 2.

TABLE 1

| Test No. | Composition of magnet powder (% by weight) | | | | | | |
|---|---|---|---|---|---|---|---|
| | Sm | Co | La | Ce | Pr | Nd | La + Ce + Pr + Nd |
| 1 | 32.8 | 67.0 | 0.05 | 0.02 | 0.05 | 0.02 | 0.14 |
| 2 | 33.1 | 66.7 | 0.05 | 0.01 | 0.03 | 0.05 | 0.14 |
| 3 | 33.3 | 66.5 | 0.02 | 0.02 | 0.05 | 0.02 | 0.11 |
| 4 | 32.7 | 65.5 | 1.4 | 0.05 | 0.02 | 0.03 | 1.5 |
| 5 | 32.7 | 65.4 | 0.04 | 0.03 | 1.4 | 0.03 | 1.5 |
| 6 | 32.8 | 64.5 | 0.05 | 2.2 | 0.05 | 0.07 | 2.37 |
| 7 | 32.8 | 64.4 | 0.06 | 0.05 | 0.03 | 2.2 | 2.34 |
| 8 | 32.7 | 65.0 | 0.7 | 0.5 | 0.5 | 0.4 | 2.1 |
| 9 | 34.6 | 65.1 | 0.04 | 0.02 | 0.06 | 0.02 | 0.14 |
| 10 | 31.3 | 68.5 | 0.05 | 0.02 | 0.05 | 0.02 | 0.14 |
| 11 | 33.6 | 64.7 | 1.4 | 0.06 | 0.02 | 0.03 | 1.51 |
| 12 | 31.8 | 66.5 | 1.3 | 0.05 | 0.02 | 0.04 | 1.41 |

TABLE 2

| Test No. | Br (kG) | $_bH_C$ (kOe) | $(BH)_{max}$ (MGOe) |
|---|---|---|---|
| 1 | 6.40 | 5.30 | 9.50 |
| 2 | 6.50 | 5.50 | 10.0 |
| 3 | 6.44 | 5.45 | 9.80 |
| 4 | 6.25 | 4.40 | 8.50 |

TABLE 2-continued

| Test No. | Br (kG) | $_bH_C$ (kOe) | $(BH)_{max}$ (MGOe) |
|---|---|---|---|
| 5 | 6.30 | 4.45 | 8.65 |
| 6 | 5.50 | 4.10 | 6.85 |
| 7 | 5.70 | 3.20 | 6.40 |
| 8 | 5.00 | 3.50 | 6.20 |
| 9 | 5.47 | 4.40 | 6.45 |
| 10 | 6.35 | 2.20 | 4.77 |
| 11 | 5.65 | 4.10 | 6.90 |
| 12 | 6.15 | 3.00 | 6.00 |

Magnet powder samples of varying percentage compositions indicated in Table 3 were prepared by the reduction-diffusion method, (not including a heat treatment) and were processed by following the procedure used on the samples of the melt method described above to produce resin magnets. These resin magnets were similarly tested for the same magnetic properties as described above. The results are shown in Table 4.

TABLE 3

| Test No. | Composition of magnet powder (% by weight) | | | | | | | |
|---|---|---|---|---|---|---|---|---|
| | Sm | Co | La | Ce | Pr | Nd | Ca | La + Ce + Pr + Nd |
| 13 | 32.7 | 66.8 | 0.05 | 0.05 | 0.1 | 0.1 | 0.1 | 0.3 |
| 14 | 33.4 | 66.0 | 0.05 | 0.1 | 0.1 | 0.1 | 0.1 | 0.35 |
| 15 | 33.1 | 66.5 | 0.05 | 0.05 | 0.1 | 0.1 | 0.1 | 0.3 |
| 16 | 32.7 | 66.0 | 0.9 | 0.05 | 0.1 | 0.05 | 0.1 | 1.1 |
| 17 | 32.7 | 65.9 | 0.05 | 1.0 | 0.05 | 0.1 | 0.1 | 1.2 |
| 18 | 32.8 | 65.7 | 0.05 | 0.05 | 1.1 | 0.1 | 0.1 | 1.3 |
| 19 | 32.7 | 65.8 | 0.05 | 0.1 | 0.05 | 1.1 | 0.1 | 1.3 |
| 20 | 32.9 | 65.4 | 1.4 | 0.1 | 0.05 | 0.05 | 0.1 | 1.6 |
| 21 | 32.8 | 65.4 | 0.05 | 1.4 | 0.1 | 0.1 | 0.1 | 1.65 |
| 22 | 32.9 | 65.4 | 0.05 | 0.1 | 1.4 | 0.05 | 0.1 | 1.6 |
| 23 | 32.9 | 65.4 | 0.05 | 0.05 | 0.1 | 1.4 | 0.1 | 1.6 |
| 24 | 33.0 | 65.2 | 0.5 | 0.4 | 0.4 | 0.4 | 0.1 | 1.7 |
| 25 | 32.8 | 64.4 | 0.7 | 0.7 | 0.4 | 0.5 | 0.1 | 2.3 |
| 26 | 33.2 | 64.1 | 0.6 | 0.7 | 0.4 | 0.5 | 0.1 | 2.2 |
| 27 | 35.5 | 64.0 | 0.1 | 0.1 | 0.05 | 0.05 | 0.1 | 0.3 |
| 28 | 32.1 | 67.0 | 0.1 | 0.1 | 0.05 | 0.05 | 0.1 | 0.3 |
| 29 | 34.3 | 64.5 | 0.9 | 0.1 | 0.05 | 0.1 | 0.1 | 1.15 |
| 30 | 31.1 | 67.5 | 1.0 | 0.1 | 0.1 | 0.05 | 0.1 | 1.25 |

TABLE 4

| Test No. | Br (kG) | $_bH_C$ (kOe) | $(BH)_{max}$ (MGOe) |
|---|---|---|---|
| 13 | 6.45 | 5.35 | 9.60 |
| 14 | 6.40 | 5.40 | 9.50 |
| 15 | 6.47 | 5.50 | 9.90 |
| 16 | 6.15 | 5.70 | 9.47 |
| 17 | 6.20 | 5.60 | 9.40 |
| 18 | 6.55 | 4.90 | 9.50 |
| 19 | 6.50 | 5.00 | 9.45 |
| 20 | 5.85 | 4.05 | 7.10 |
| 21 | 5.70 | 4.35 | 7.15 |
| 22 | 6.20 | 3.95 | 7.60 |
| 23 | 6.00 | 3.55 | 7.70 |
| 24 | 6.10 | 3.85 | 6.50 |
| 25 | 6.35 | 3.75 | 6.35 |
| 26 | 6.17 | 3.50 | 5.90 |
| 27 | 5.40 | 4.37 | 6.15 |
| 28 | 6.10 | 2.95 | 5.00 |
| 29 | 5.60 | 4.20 | 6.17 |
| 30 | 6.35 | 2.10 | 4.80 |

The magnet powder samples shown in Table 1 and Table 3 were subjected to X ray diffraction. The results show that the samples of Test Nos. 1, 2, 13, and 15 invariably consisted solely of a single phase of $SmCo_5$ intermetallic compound, the samples of Test Nos. 10, 12, 25, and 27 invariably contained a $Sm_2Co_{17}$ phase in addition to the $SmCo_5$ phase, and the samples of Test Nos. 9, 11, 27, and 29 invariably contained a $SmCo_3$ phase and a $Sm_2Co_7$ phase in addition to the $SmCo_5$ phase.

These test results evince the limits imposed on the percentage composition of the magnet powder of the present invention. The limits, 32.7 and 33.4% by weight, imposed on samarium are critical because the formation of a $Sm_2Co_7$ phase heavily occurs in the magnet powder and the coercive force sharply falls if the samarium content is less than 32.7% by weight and the formation of a $Sm_2Co_7$ phase occurs and the residual magnetic flux density falls if the samarium content exceeds 33.4% by weight.

The limit of 65.0 to 67.0% by weight of cobalt is critical for the same reasons as given above with respect to the samarium content. The cobalt content in this range is necessary for the formation of the $SmCo_5$ phase.

The upper limit of 1.5% by weight for the total amount of lanthanum, cerium, praseodymium, and neodymium is critical because the magnetic properties, particularly the coercive force, of the produced magnet powder are sharply degraded if the total amount of the four elements exceeds 1.5% by weight.

The incorporation of lanthanum, cerium, praseodymium, and neodymium in the magnet powder may be effected by adding these elements to metallic samarium, metallic cobalt, oxide of samarium, etc., which are used as main raw materials for the production of the magnet powder. For simplicity of production, however, it is effected preferably by using raw materials which contain the elements in amounts satisfying the percentage composition mentioned above. The average particle size of the magnet powder is in the range of 1 to 20 μm, preferably 5 to 10 μm.

As described above, by limiting the content of samarium in a specific range and specifically limiting the total amount of lanthanum, cerium, praseodymium, and neodymium to be contained, this invention brings about an outstanding effect of producing a samarium-cobalt type magnet powder exhibiting such magnetic properties as residual magnetic flux density, coercive force, and maximum energy product consistently, stably and excellently and, therefore, providing suitable for resin magnet.

Now, the present invention will be described more specifically below with reference to working examples.

EXAMPLE 1

(1) Preparation of magnet powder

In an arc melting furnace, 66.2 g of metallic samarium containing 0.3% of La, 0.1% of Ce, 0.1% of Pr, and 0.2% of Nd by weight and 133.6 g of metallic cobalt were melted and cast. The samarium-cobalt alloy ingot consequently obtained was finely puluerized in a rotaty ball mill until an average particle size of 6 μm. As the result, there was obtained 190 g of magnet powder. The composition of this magnet powder is shown in Table 5.

(2) Determination of magnetic properties

The magnet powder obtained in (1) above and 8.5% by weight of polyamide resin (nylon 6) added therein in an extrapolative ratio were kneaded and pelletized and injection molded in a magnetic field of 15 kOe, to produce resin magnet.

The resin magnet so obtained was tested for the magnetic properties, i.e. residual magnetic flux density, coercive force, and maximum energy product by the method described above. The results are shown in Table 6. The magnet powder, by X-ray diffraction analysis, was found to consist solely of a single phase of $SmCo_5$ intermetallic compound.

EXAMPLE 2

(1) Preparation of magnet powder

A pot of mild steel was packed with a mixture of 137 g of samarium oxide containing 0.2% of La, 0.1% of Ce, 0.1% of Pr, and 0.1% of Nd by weight with 237 g of cobalt powder and 70 g of calcium powder, set in place in a reaction device, and heated in an atmosphere of argon gas, retained at 980° C. for one hour, and then cooled to room temperature. The reaction product was treated with water and a dilute acetic acid of about pH 2.5 to be deprived of the entrained CaO and the unreacted calcium. The powder consequently obtained was treated with alcohol to remove the adhering water by substitution and dried. The dry powder was placed in a rotary ball mill, covered with ethyl alcohol, and pulverized for two hours. Consequently, there was obtained 340 g of magnet powder having an average particle size of 6 μm. The composition of the magnet powder is shown in Table 5.

(2) Determination of magnetic properties

Resin magnet was prepared from the magnet powder obtained in (1) above by following the procedure of Example 1 and then tested for magnetic properties in the same way as in Example 1. The results are shown in Table 6. The magnet powder, by X-ray diffraction analysis, was found to consist solely of a single phase of $SmCo_5$ intermetallic compound.

COMPARATIVE EXPERIMENT 1

In an arc melting furnace, 66.9 g of metallic samarium and 136.6 g of metallic cobalt were melted and cast. The alloy ingot consequently obtained was kept in an atmosphere of argon gas at 1,150° C. for one hour to effect solid solution. It was then aged at 850° C. for 6 hours, cooled to room temperature, and pulverized in a rotary ball mill. As the result, there was obtained 195 g of magnet powder having the same average particle size as the magnet powder of Example 1. The composition of this magnet powder is shown in Table 5.

Resin magnet was obtained from the magnet powder obtained above by following the procedure of Example 1 and tested similarly for magnetic properties. The results are shown in Table 6.

The magnet powder, by X-ray diffraction analysis, was found to contain a $Sm_2Co_{17}$ phase in addition to the $SmCo_5$ phase.

COMPARATIVE EXPERIMENT 2

In an arc melting furnace, 66.5 g of metallic samarium containing 1.0% of La, 1.5% of Ce, 3.3% of Pr, and 0.5% of Nd by weight and 134.6 g of metallic cobalt were melted and cast. The samarium-cobalt alloy ingot so obtained was finely pulverized in a rotary ball mill until an average particle size of 6 μm. As the result, there was obtained 196 g of magnet powder. The composition of this magnet powder is shown in Table 5.

Resin magnet was prepared from the magnet powder obtained as described above by following the procedure of Example 1 and was similarly tested for magnetic properties. The results are shown in Table 6. The magnet powder, by X-ray diffraction analysis, was found to contain a $Sm_2Co_7$ phase in addition to the $SmCo_5$ phase.

COMPARATIVE EXPERIMENT 3

A mixture of 137 g of samarium oxide powder with 242 g of cobalt powder and 70 g of calcium powder was kept at 980° C. for one hour, subjected to the same heat treatment as in Comparative Experiment 1, and then treated in the same manner as in Example 2. As the result, there was obtained 350 g of magnet powder. The composition of this magnet powder is shown in Table 5.

Resin magnet was produced from the magnet powder obtained above by following the procedure of Example 1 and was similarly tested for magnetic properties. The results are shown in Table 6.

The magnet powder, by X-ray diffraction analysis, was found to contain a $Sm_2Co_{17}$ phase in addition to the $SmCo_5$ phase.

COMPARATIVE EXPERIMENT 4

A pot of mild steel was packed with 150 g samarium oxide, 242 g of cobalt powder, and 75 g of calcium powder, set in place in a reaction device, heated in an atmosphere of argon gas, kept at 980° C. for one hour, and then cooled to room temperature. The reaction product so obtained was treated with water and dilute acetic acid at about pH 2.5 to be deprived of the entrained CaO and the unreacted calcium. The powder consequently obtained was treated with alcohol to remove the adhering water by substitution, and drive. The drive powder was placed in a rotary ball mill, covered with ethyl alcohol, and pulverized for two hours. As the result, there was obtained 348 g of magnet powder having an average particle size of 6 μm. The composition of the magnet powder is shown in Table 5.

Resin powder was produced from the magnet powder obtained above by following the procedure of Example 1 and was similarly tested for magnetic properties. The results are shown in Table 6.

The magnet powder, by X-ray diffraction analysis, was found to contain a $Sm_2Co_7$ phase in addition to the $SmCo_5$ phase.

TABLE 5

| | Composition of magnet powder (% by weight) | | | | | | | |
|---|---|---|---|---|---|---|---|---|
| | Sm | Co | La | Ce | Pr | Nd | La + Ce + Pr + Nd | Ca |
| Example 1 | 33.1 | 66.7 | 0.05 | 0.01 | 0.03 | 0.05 | 0.14 | — |
| Example 2 | 33.1 | 66.5 | 0.05 | 0.05 | 0.1 | 0.1 | 0.3 | 0.1 |
| Comparative Experiment 1 | 32.4 | 67.4 | <0.01 | <0.01 | <0.01 | <0.01 | | |
| Comparative Experiment 2 | 32.9 | 65.2 | 0.13 | 0.16 | 1.4 | 0.07 | 1.76 | — |
| Comparative Experiment 3 | 32.2 | 67.4 | <0.01 | <0.01 | <0.01 | <0.01 | — | 0.1 |
| Comparative Experiment 4 | 34.3 | 65.2 | 0.05 | 0.1 | 0.1 | 0.1 | 0.35 | 0.1 |

TABLE 6

| | Br (kG) | $b^{H}C$ (kOe) | $(BH)_{max}$ (MGOe) |
|---|---|---|---|
| Example 1 | 6.50 | 5.50 | 10.0 |
| Example 2 | 6.47 | 5.50 | 9.90 |
| Comparative Experiment 1 | 6.10 | 3.05 | 5.15 |
| Comparative Experiment 2 | 6.10 | 3.85 | 7.30 |
| Comparative Experiment 3 | 6.05 | 2.95 | 5.00 |
| Comparative Experiment 4 | 5.60 | 4.10 | 6.10 |

What is claimed is:

1. A samarium-cobalt type magnet powder for use in making a resin magnet, said magnet powder consisting of, by weight of total powder, of 32.7 to 33.4% of samarium; 65.0 to 67.0% of cobalt, said samarium and said cobalt being present as a single phase of $SmCo_5$; up to 1.5% of an additive element selected from the group consisting of lanthanum, cerium, praseodymium and neodymium, at least one said additive element being present; and a balance of inevitably entrained impurities.

2. A magnet powder according to claim 1, wherein said inevitably entrained impurities comprise Ca.

3. a magnet powder according to claim 1, wherein said magnet powder as an average particle size in the range of 1 to 20 μm.

4. A magnet powder according to claim 3, wherein said average particle size is in the range of 5 to 10 μm.

5. A mixture of a samarium-cobalt type magnet powder with a resin for use in making a resin magnet, said magnet powder consisting of, by weight of total powder, of 32.7 to 33.4% of samarium; 65.0 to 67.0% of cobalt, said samarium and said cobalt being present as a single phase of $SmCo_5$; up to 1.5% of an additive element selected from the group consisting of lanthanum, cerium, praseodymium and neodymium, at least one said additive element being present; and a balance of inevitably entrained impurities; and said resin being selected from a thermoplastic resin and a thermosetting resin.

6. A mixture according to claim 5, wherein said thermoplastic resin is at least one member selected from the group consisting of a polyamide resin, a polycarbonate resin, an acrylonitrile-butadiene-styrene copolymer resin, a polyphenylene sulfide resin, and a polyether ether ketone resin.

7. A mixture according to claim 5, wherein said thermoplastic resin is at least one member selected from the group consisting of an epoxy resin, a phenol resin, an amino resin, and an unsaturated polyester resin.

8. A samarium-cobalt type magnet powder for use in making a resin magnet, said magnet powder consisting of, by weight of total powder, of 32.7 to 33.4% of samarium; 65.0 to 67.0% of cobalt, said samarium and said cobalt being present as a single phase of $SmCo_5$; up to 1.5% of an additive element selected from the group consisting of lanthanum, cerium, praseodymium and neodymium, at least one additive element being present; and a balance of inevitably entrained impurities; said magnet powder being formed without a heat treatment by the steps of melting a mixture of said samarium, cobalt and additive element, casting said mixture into ingots, and pulverizing said ingots to form said magnet powder.

9. A samarium-cobalt type magnet powder for use in making a resin magnet, said magnet powder consisting of, by weight of total powder, of 32.7 to 33.4% of samarium; 65.0 to 67.0% of cobalt, said samarium and said cobalt being present as a single phase of $SmCo_5$; up to 1.5% of an additive element selected from the group consisting of lanthanum, cerium, praseodymium nd neodymium, at least one additive element being present; and a balance of inevitably entrained impurities; said magnet powder being formed without a heat treatment by the steps of forming a mixture of samarium oxide cobalt and additive element, subjecting said mixture to a reduction-diffusion reaction to form a reaction product, throwing said reaction product in cold water to produce a slurry, and adding water and an aqueous acid solution to said slurry to form said magnet powder.

* * * * *